US009636564B1

(12) United States Patent
Arnold

(10) Patent No.: US 9,636,564 B1
(45) Date of Patent: May 2, 2017

(54) GOLF SWING ALIGNMENT AND AIMING SYSTEM

(71) Applicant: Robert Arnold, Denver, CO (US)

(72) Inventor: Robert Arnold, Denver, CO (US)

( * ) Notice: Subject to any disclaimer, the term of this patent is extended or adjusted under 35 U.S.C. 154(b) by 0 days.

(21) Appl. No.: 14/726,215

(22) Filed: May 29, 2015

(51) Int. Cl.
*A63B 69/36* (2006.01)

(52) U.S. Cl.
CPC ..... *A63B 69/3641* (2013.01); *A63B 69/3667* (2013.01)

(58) Field of Classification Search
CPC ..... A63B 69/3641
See application file for complete search history.

(56) References Cited

U.S. PATENT DOCUMENTS 4,322,084 A 3/1982 Reece et al.
4,993,716 A * 2/1991 Waller ..... A63B 69/3608 473/218
5,246,234 A 9/1993 Zambell
5,322,288 A 6/1994 Amis
5,464,220 A 11/1995 Hansen et al.
7,037,210 B2 5/2006 Bainter
7,241,228 B2 7/2007 Bruschi
7,261,640 B1 8/2007 Baggott
7,775,900 B1 8/2010 Karpyak et al.
2006/0063603 A1* 3/2006 Bruschi ..... A63B 69/3667 473/270
2014/0121033 A1 5/2014 Maddox

* cited by examiner

*Primary Examiner* — Michael Dennis
(74) *Attorney, Agent, or Firm* — Ramon L. Pizarro; Edwin H. Crabtree

(57) ABSTRACT

A golf swing alignment and swing-aiming device is disclosed. An embodiment of the device includes a main elongated member, an aim arm that is pivotally connected to the main elongated member, an aiming strip that is pivotally connected to the aim arm, and a ball positioning arm that is pivotally connected to the main member at a location near the second end of the main member. The device collapses so that it can fit inside a club sheath in a golf bag, and can be unfolded to allow the user to position the aiming strip in a parallel arrangement with the main member, so that the aiming strip can be used to guide the swing of a golf club while positioning one's feet along the main member.

5 Claims, 2 Drawing Sheets

GOLF SWING ALIGNMENT AND AIMING SYSTEM

BACKGROUND OF THE INVENTION (a) Field of the Invention

This application relates to a system for helping golfers align and aim their golf swing. More particularly, but without limitation, to a system that can be collapsed to fit in a standard golf club tube, and which provides a swing alignment member, which allows the user to aim the swing at a desired ball travel path.

(b) Discussion of Known Art

Domination of the golf swing has proven to be an elusive goal for many individuals. There are many known devices designed to help these golfers with instilling the proper stance and club swing. Examples of these devices include U.S. Pat. No. 1,922,130 to Haserdot and U.S. Patent App. Pub. Nos. 2010/0248855, 2010/0144458, and 2010/006916, which show the use of a cross-shaped member to aid in positioning one's feet while preparing to swing a golf club.

Another illustrative approach is found in U.S. Patent App. Pub. No. 2010/0069168 to Rhodes shows the used of hinged connections to position a mat that is used to position the golf ball relative to hinged bars. Another approach is shown in U.S. Pat. No. 4,384,718 to Cachola, which shows a pair of parallel bars that are connected to one another through a pivoting member. Still further, U.S. Pat. No. 1,517,555 to Graham shows the use of four bars that are connected to one another through a track. U.S. Patent Application Publication 2006/0063603 to Bruschi discloses a device with several bars or segments and lockable hinge members used to angles of the bars relative to one another.

Therefore, a review of known devices reveals that there remains a need for a simple device that can accommodate the differences in body sizes of the user.

Still further, there remains a need for a device that not only helps the user in positioning his or her feet in preparation for the golf swing, but also helps the user aim the swing.

There remains a need for a device that can be used by golfers achieve the proper stance and which can be easily stowed in a golf bag between shots.

There remains a need for a device that can be used by golfers achieve the proper stance and which allows precise alignment of the of the section to ensure parallel arrangement of the component, and proper alignment with the desired ball trajectory.

SUMMARY

It has been discovered that the problems left unanswered by known art can be solved by providing a golf swing alignment and swing aiming device that includes:

A main member, the main member having a first end and a second end;

An aim arm that has an aim arm first end and an aim arm second end;

An aiming strip; and

A ball positioning arm connected to the main member at a location near the second end of the main member.

In a preferred embodiment the aim arm second end will be pivotally connected to the aiming strip. Additionally, angle graduations or angle determination markings will be included at the intersection of the aim arm and the aiming strip, and at the intersection of the aim arm and the main member, so the aiming strip and the main member can be positioned in a parallel manner relative to one another.

According to a highly preferred example of the invention, angle markings or graduations will be used between the aim arm and the aiming strip, as well as between the aim arm and the main member. This allows the user to create a parallel relationship between the main member and the aiming strip by simply making sure that the alternate interior angles created by the transversal of the aiming strip and the main member by the aiming arm.

Accordingly, the disclosed invention accommodates differences a user's body proportions or sizes, as well as the lengths of the shafts of the club being used. The aiming strip should be parallel to the main member in order to obtain the optimal benefit of the disclosed invention. Accordingly, since a tall person is likely to swing the club along a path that is further from the main member than would a club that is swung by shorter person, the disclosed invention provides for adjustment of the distance between the aiming strip and the main member. A similar situation would be presented by changing clubs. An iron, which typically includes a shaft that is shorter than a wood, is typically swung along a different path than a wood. The ability to move the aiming strip relative to the main member and maintain the parallel relationship of these two members allows the disclosed invention to provide an aiming strip that can be used by individuals of various sizes and clubs of varying lengths.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
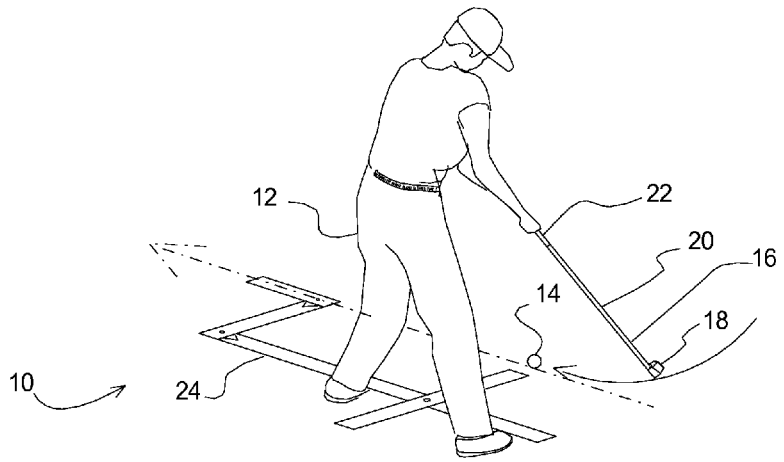
FIG. 1 illustrates the invention while in use.

Turning now to FIG. 1 where a golf swing alignment and swing-aiming device 10 made in accordance with the principles disclosed herein has been illustrated while in use. The swing alignment and swing-aiming device 10 is designed to help a golfer 12 align his stance and his swing when hitting a golf ball 14 with a golf club 16. The golf club 16 includes a club head 18, a club shaft 20, and a club grip 22.

Figure 2:
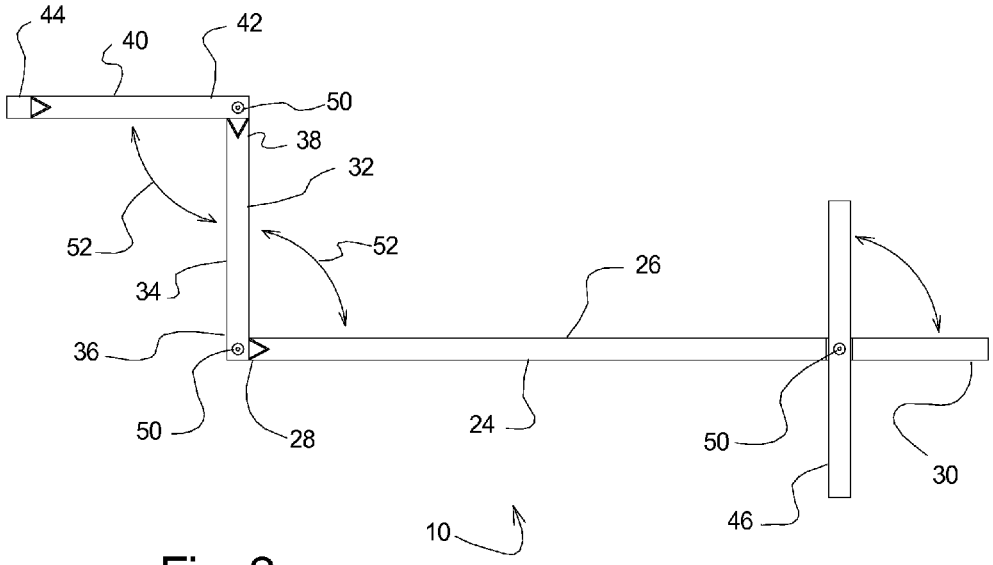
FIG. 2 is a top, plan view, of the disclosed invention in an unfolded state.

Referring now to FIGS. 1 and 2 it will be understood that the disclosed golf swing alignment and swing-aiming device 10 includes a main member 24 that in a preferred embodiment is a first straight elongated member 26, that is preferably made of a resilient or generally rigid material. The main member 24 includes a main member first end 28 and a main member second end 30.

In a preferred embodiment of the invention an aim arm 32 that is attached or attachable to the first end 28 of the main member 24 comprising a second straight elongated member 34 having an aim arm first end 36 and an aim arm second end 38. The attachment of the aim arm 32 to the main member 24 being through the first end 36 of the aim arm 32. Preferably, the attachment is carried out through a mechanical fastener, such as a rivet or pin, which allows rotation of the aim arm 32 relative to the main member 24. However, it is contemplated that other attachment mechanisms that allow adjustment of the angle between the aim arm 32 and the main member 24 may be used, for example hook and loop material, snaps, or similar devices may also be used.

FIGS. 1 and 2 also show that an aiming strip 40 that preferably includes a third straight elongated member 42 is provided for allowing the user to align the swing of the club 16 such that the face of the club head 18 is generally square with the length of the aiming strip 40 as the club head 18 travels through the location of the ball 14. The aiming strip 40 includes an aiming strip first end 42 and an aiming strip second end 44. The aiming strip 40 may be made of the same material as the main member 24, or of another material, including a flexible material. However, in the preferred embodiment of the invention the aiming strip 40 and the main member 24 are both made from a plastic extrusion.

Still further, a ball positioning arm 46, of similar construction as the aiming strip 40 and the main member 24 is pivotally connected to the main member 24 at a location near the main member second end 30. All of the pivoting connections of the disclosed invention may be made using connectors that allow the members to rotate relative to one another at the connection, thus pins, rivets, hook and loop material, snaps, or similar devices may also be used.

As illustrated in FIG. 1, the pivoting connections of the disclosed invention allow the user to position the ball positioning arm 46 at a right angle to the main member 24 and placing the golf ball 18 in-line with the ball positioning arm 46, all while positioning the aiming strip 40 in a parallel relationship to the main member 24, allows the user to see the aiming strip the user's peripheral vision while swinging the golf club head towards the ball 14, and thus allowing the user to align the golf club head 18 and its face with the aiming strip 40 during the swing.

Figure 3:
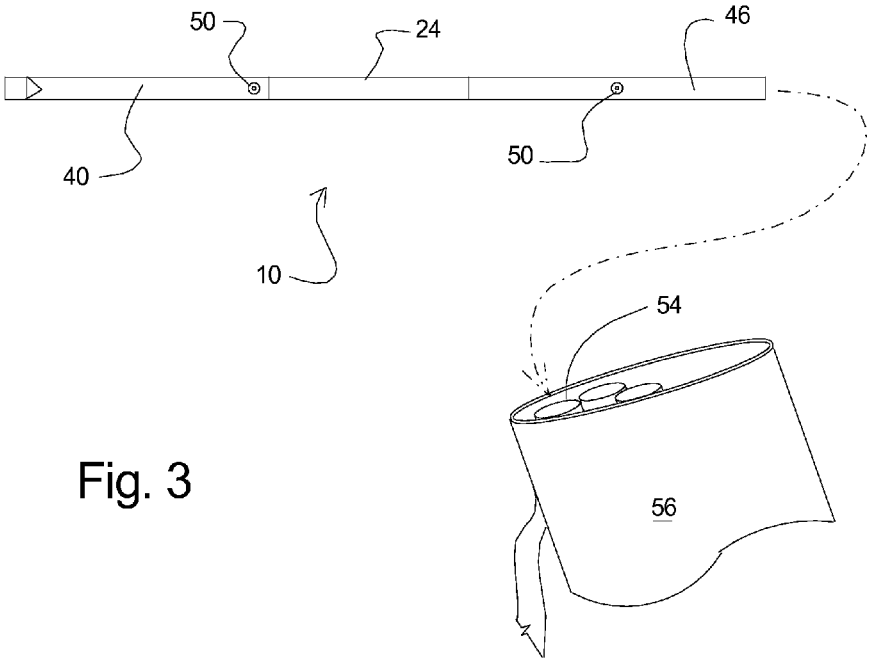
FIG. 3 is a top, plan view, of the disclosed invention in a folded state, before insertion into a sheath in a golf bag.

Turning now to FIGS. 2 and 3 it will be understood that it is contemplated that the ball positioning arm 46 is of a length will be pivotally supported from the main member 24 at a location that is approximately mid-length of the ball positioning arm 46, and thus allowing the user to position his feet at equal distances from the ball positioning arm 46, causing the user's head to be positioned directly in front of the ball 14.

Figure 4:
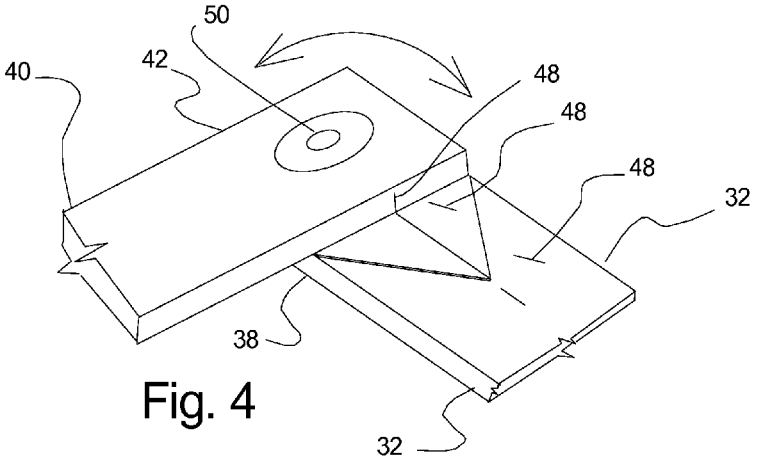
FIG. 4 illustrates an example of markings used to index the angles of the individual strips or aiming arms relative to one another.

Turning now to FIGS. 2-4, it will be understood that the golf swing alignment and swing-aiming device 10 will include angle graduations 48 near pivoting or rotatable connections, such as the connection 50 between the aim arm first end 42 and the aim arm second end 38, well as the connection between the aim arm first end 36 and the main member first end 28. The graduations allow the user to keep the aiming strip 40 and the main member 24 parallel to one another by ensuring that the alternate interior angles 52 are the same. Thus, it will be understood that the distance between the aiming strip 40 and the main member 24 can be varied to adjust for different clubs or for users of different statures, while allowing the user to guide or aim the path of the club by using the presence of the aiming strip 40, which can be seen through the user's peripheral vision.

Still further, FIG. 3 illustrates that the lengths of the members of the disclosed invention and the use of the adjustable or rotatable connections between these members allows the golf swing alignment and swing-aiming device 10 to collapse, such that all of the members lie over one another and over the main member 24, which has been sized to fit within a typical sheath 54 or pocket within a golf bag 56. This allows the user to carry the disclosed invention as if carrying another club in the golf bag 56, which allows the user to use the disclosed invention as needed.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A golf swing alignment and swing-aiming device that is collapsible through the use of pivoting connections, so as to allow all components of the device to remain attached to one another at all times and carrying of the device in a folded arrangement in a golf bag and lay substantially flat when in use, the device comprising:

a main member, the main member being generally linear and having a main member first end and a main member second end;

an aim arm that is generally linear and has an aim arm first end and an aim arm second end;

an aiming strip that is generally linear; and a ball positioning arm that is generally linear and of a length, the first end of the main member being pivotally connected to the first end of the aim arm, the aim arm second end being pivotally connected to the aiming strip, the ball positioning arm being pivotally supported from the main member at a location that is approximately mid-length of the ball positioning arm, allowing the user to position his feet at equal distances from the ball positioning arm, causing the user's head to be positioned directly in front of the ball; and angle graduations on the aim arm and on the aiming strip, the angle graduations being next to the pivotal connection between the aim arm and the main member and between the aim arm and the aiming strip, so that the aiming strip may be positioned at a desired angle to relative to the aim arm, and so that a parallel relationship between the aiming strip and the main member can be established when changing the angle of the aim arm and the main member; and so that the swing-aiming device may be collapsed to position the aim arm, aiming strip, main member, and ball positioning member next to one another in a parallel manner, so that the collapsed device may be transported in the golf bag when not in use.

2. A golf swing alignment and swing-aiming device according to claim 1 wherein the ball positioning arm is pivotally supported from the main member at a distance from the aim arm, and the main member further having an angle graduation next to the pivotal connection of the ball positioning arm and the main member, the angle graduation next to the pivotal connection of the ball positioning arm and the main member being parallel to the ball positioning arm when the ball positioning arm is perpendicular to the main member.

3. A golf swing alignment and swing-aiming device for use while hitting a golf ball with a golf club having a club head, the device being collapsible through the use of pivoting connections, so as to keep all components together at all times and allow carrying of the device in a golf bag and laying substantially flat when in use, the device comprising:

a main member comprising a first straight elongated member, the main member having a main member first end and a main member second end;

an aim arm comprising a second straight elongated member having an aim arm first end and an aim arm second end;

an aiming strip comprising a third straight elongated member having an aiming strip first end and an aiming strip second end;

angle graduations on the aim arm and on the aiming strip, the angle graduations being next to the pivotal connection between the aim arm and the main member and the aim arm and the aiming strip; and a ball positioning arm of a length, the ball positioning arm being pivotally connected to the main member at a location near the main member second end from a location that is approximately mid-length along the ball positioning arm, the main member further having an angle graduation next to the pivotal connection of the ball positioning, the angle graduation next to the pivotal connection of the ball positioning arm and the main member being parallel to the ball positioning arm when the ball positioning arm is perpendicular to the main member, the first end of the main member being pivotally connected to the first end of the aim arm, and the second end of the aim arm being pivotally connected to the aiming strip second end, so that the aiming strip can be moved towards and away from the main member while maintaining the aim arm in a parallel relationship to the main member, so that positioning the ball positioning arm is at a right angle to the main member and the ball positioning arm is divided by the main member, and so that and placing a golf ball in-line with the ball positioning arm while positioning the aiming strip in a parallel relationship to the main member makes the aiming strip visible to the person while swinging the golf club head towards the ball while swinging the club and allows the path of the golf club head to be aligned with the aiming strip, and so that the ball positioning arm indicates the desired position of the user's feet and head relative to the ball when the ball is aligned with the ball positioning arm.

4. A golf swing alignment and swing-aiming device according to claim 3 wherein said aim arm includes the angle graduations on the aim arm first end and on the aim arm second end.

5. A golf swing alignment and swing-aiming device according to claim 4 wherein the pivotal connection between the aiming strip and the aim arm, the pivotal connection between the aim arm and the main member, and the pivotal connection between the main member and the ball positioning arm allow the aiming strip, aim arm, and ball positioning arm to pivot to a position where the aiming strip, the aim arm, the ball positioning arm and the main member are all parallel to one another allowing the swing-aiming device to lay generally flat when in use.

* * * * *